US006957750B1

(12) United States Patent
Trudell

(10) Patent No.: US 6,957,750 B1
(45) Date of Patent: Oct. 25, 2005

(54) CANE WITH PEPPER SPRAY DISPENSER

(76) Inventor: Edmund Trudell, 109 Havenview La., Oceanside, CA (US) 92056

( * ) Notice: Subject to any disclaimer, the term of this patent is extended or adjusted under 35 U.S.C. 154(b) by 43 days.

(21) Appl. No.: 11/036,950

(22) Filed: Jan. 14, 2005

Related U.S. Application Data

(60) Provisional application No. 60/537,181, filed on Jan. 16, 2004.

(51) Int. Cl.[7] ..... B67D 5/64
(52) U.S. Cl. ..... 222/174; 222/192; 135/66; 135/83
(58) Field of Search ..... 222/79, 174, 192; 135/66, 83

(56) References Cited

U.S. PATENT DOCUMENTS 2,385,091 A * 9/1945 Lukowitz ..... 222/174
4,625,742 A 12/1986 Phillips ..... 135/66
5,065,904 A 11/1991 McCaffrey et al. ..... 222/3
5,901,723 A 5/1999 Ames ..... 135/66

* cited by examiner

*Primary Examiner*—Philippe Derakshani
(74) *Attorney, Agent, or Firm*—Richard W. Goldstein

(57) ABSTRACT

A cane with a pepper spray dispenser. The cane comprises a horizontal handle and a vertical member. The vertical member is preferably permanently attached to the handle near a first end thereof. A substantially cylindrical cap covers the bottom portion of the vertical member and provides firm traction. A container of pressurized pepper spray extends vertically from the handle to the vertical member. A button is in fluid communication with the container and is located along the upper surface thereof. In its closed position, a cover shields the button from the external environment and prevents it from being accidentally activated. The user can slide the cover into an open position along a pair of tracks in the handle, aim the nozzle near the eyes of the criminal and depress the button. The released pepper spray incapacitates the attacker for a significant period of time and allows the user to escape.

3 Claims, 2 Drawing Sheets

CANE WITH PEPPER SPRAY DISPENSER

CROSS REFERENCES AND RELATED SUBJECT MATTER

This application is a continuation of provisional patent application Ser. No. 60/537,181, filed in the United States Patent Office on Jan. 16, 2004.

BACKGROUND OF THE INVENTION

1. Field of the Invention

The invention generally relates to a cane with a pepper spray dispenser, and in particular it relates to a cane that has an internal container of pepper spray that releases when a user manually depresses a nearby trigger.

2. Description of the Related Art

Crime against senior citizens and disabled persons is an unfortunate reality that confronts people in virtually every major city in the United States on a daily basis. Criminals, realizing that the elderly are generally easier targets because of their diminished capacity to defend themselves, often mischievously focus on this segment of our society. Since American seniors are living longer and healthier than at any time in history, their numbers as a percentage of the overall population will likely continue to increase. Hence, there will be more seniors vulnerable to criminal activity in the near and distant future. In order to prevent crime of this nature, law enforcement agencies provide numerous suggestions. Some of these are: if women must carry purses, hold them close to their bodies and do not dangle them freely; place your wallet in an inside jacket pocket or a front pants pocket instead of a back pants pocket; when taking a trip, travel with at least one other person and inform someone of your destination and anticipated return time; avoid dark and deserted routes even if they are shorter than others; carry loose change for emergency telephone and transportation use; and if possible, buy and carry a cellular telephone for extra protection. Furthermore, many elderly and disabled people take additional precautions such as carrying various self-defense devices.

However, significant drawbacks are associated with the use of many of these devices. For example, tasers are very expensive and not widely available to the general public. Stun guns are a generally ineffective deterrent. Pepper spray, on the other hand, is inexpensive and highly reliable. When deployed properly, pepper spray can transform even the largest of attackers into blind and stumbling criminal wannabes. Nevertheless, effectively accessing pepper spray is a major obstacle for senior citizens and disabled people. Often, these people walk with the assistance of a cane and only have one hand available to perform other tasks. Therefore, they must place the container of pepper spray in a separate area. For men, this location is most likely a coat pocket or a pants pocket, while for women it might be a purse. In either situation, the pepper spray cannot be immediately utilized and consequently is useless. Hence, there is a need for a cane with an internal container of pepper spray that releases upon demand.

U.S. Pat. No. 4,625,742 to Phillips ("Phillips") teaches a lighted walking cane that illuminates the path of a user in the dark and indicates the position of the user in relation to others. However, the cane of Phillips does not empower its user to fend off criminals and prevent attacks.

U.S. Pat. No. 5,065,904 to McCaffrey et al. ("McCaffrey") discloses a hand-held personal protection device that has a handle, a shaft and a canister section which is adapted to receive a gas-charged canister containing a noxious compound or spray. However, the device of McCaffrey is designed to protect against animal attacks and consequently has very limited application.

U.S. Pat. No. 5,901,723 to Ames ("Ames") teaches a cane that has a miniature pepper spray container and a trigger mechanism contained therein. However, pepper spray releases from a nozzle in the rubber tip of the cane of Ames and therefore cannot be deployed immediately.

While these disclosures may be suitable for the particular purposes employed, or for general use, they would not be as suitable for the purposes of the present invention as disclosed hereafter.

SUMMARY OF THE INVENTION

It is an object of the invention to provide a cane that can withstand treacherous weather conditions and is durable. Accordingly, the cane is preferably constructed from a strong non-corrosive polymeric material.

It is another object of the invention to provide a cane that assists elderly and disabled people with walking. Accordingly, the cane has a handle that a user can grasp and an integrally attached vertical member upon which the user can exert the force of his weight.

It is a further object of the invention to provide a cane that has an internal source of pepper spray. Accordingly, a container of pressurized pepper spray is positioned inside the cane.

It is a further object of the invention to provide a cane from which the user can selectively dispense pepper spray. Accordingly, the handle of the cane contains a button that the user may depress to release pepper spray from the container through a nozzle.

It is a further object of the invention to provide a cane that contains means for preventing the pepper spray from being dispensed accidentally. Accordingly, a cover encases the button while in a closed position. In order to access the button, a user must slide the cover into an open position along a pair of horizontal tracks in the handle.

The invention is a cane with a pepper spray dispenser. The cane comprises a horizontal handle and a vertical member. The vertical member is preferably permanently attached to the handle near a first end thereof. A substantially cylindrical cap covers the bottom portion of the vertical member and provides firm traction. A container of pressurized pepper spray extends vertically from the handle to the vertical member. A button is in fluid communication with the container and is located along the upper surface thereof. In its closed position, a cover shields the button from the external environment and prevents it from being accidentally activated. The user can slide the cover into an open position along a pair of tracks in the handle, aim the nozzle near the eyes of the criminal and depress the button. The released pepper spray incapacitates the attacker for a significant period of time and allows the user to escape.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
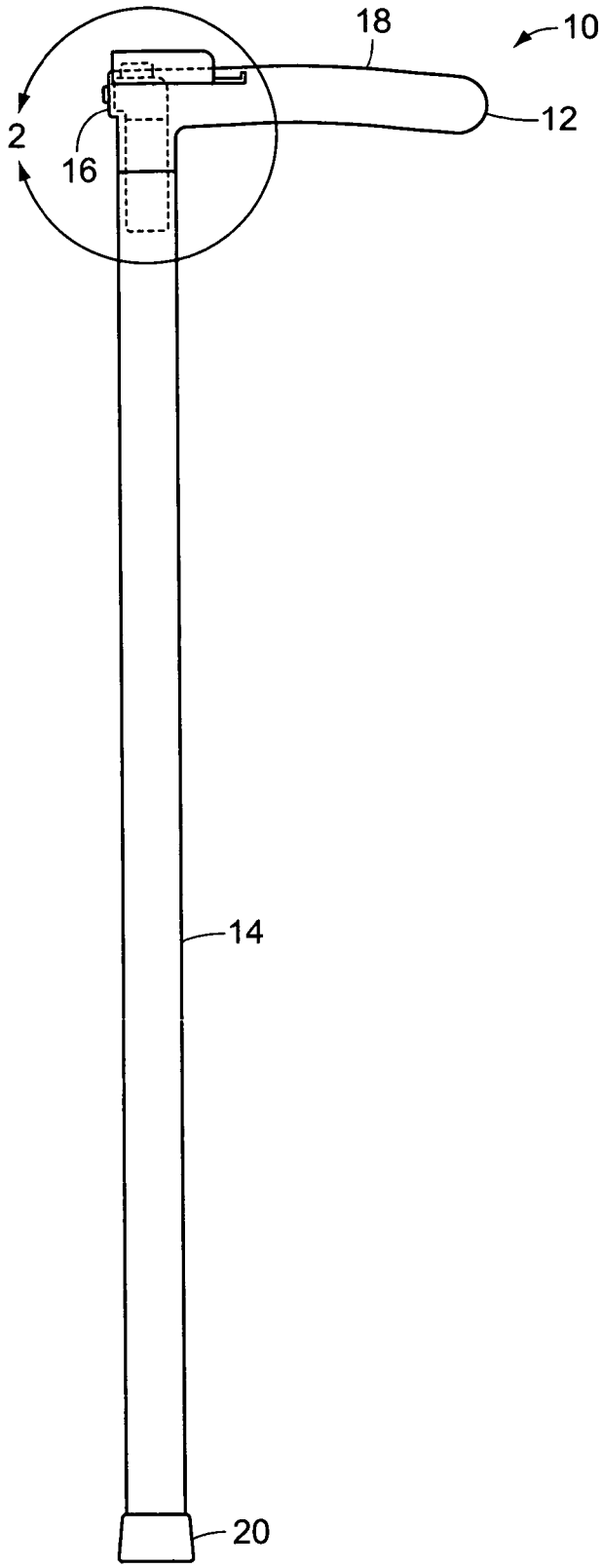
FIG. 1 is a front elevational view of a cane according to the present invention with the cover in a closed position, wherein the button, the container of pepper spray and a portion of the handle are represented by phantom lines.

FIG. 1 illustrates a cane 10 with a pepper spray dispenser according to the present invention. The cane 10 comprises a horizontal handle 18 and a vertical member 14. The vertical member 14 is integrally attached to the handle 18 near a first end 16 of the handle 18 and an upper end of the vertical member 14. Preferably, the vertical member 14 is hollow near its upper end and is welded or otherwise permanently connected to the handle 18 so that the cane 10 can be utilized as a single unit. An elderly or disabled user can grasp the handle 18 near a second end 12 which is opposite the first end 16. The user can exert the force of his weight on the vertical member 14 in order to obtain assistance with walking. A support cap 20 covers the bottom portion of the vertical member 14 and provides firm traction when the user rests the cane 10 on various ground surfaces. The cap 20 has a substantially cylindrical configuration and a diameter which is slightly larger than that of the vertical member 14. Preferably, the cane 10 is constructed from a strong non-corrosive polymeric material that can withstand repeated use in adverse weather conditions.

Figure 2:
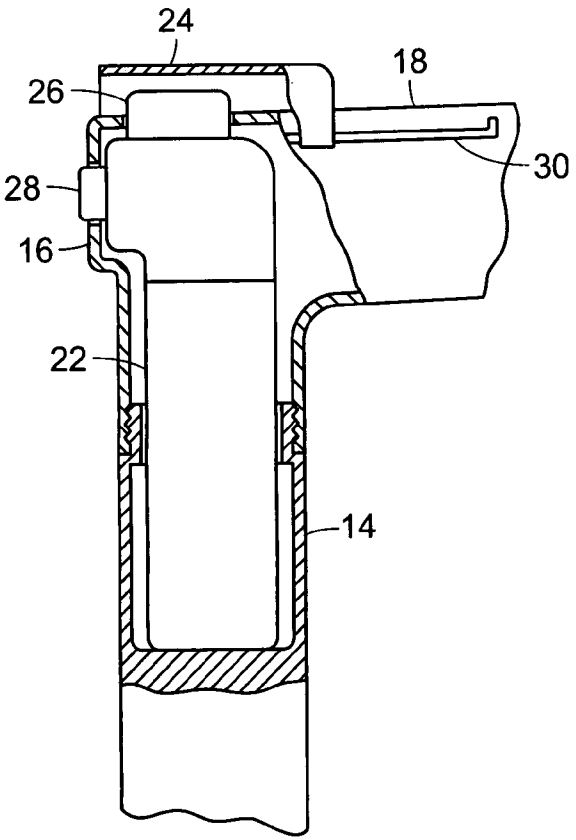
FIG. 2 is a front elevational view of the cane with the cover in a closed position and parts broken away, taken along line 2 as indicated in FIG. 1.

FIG. 2 depicts the cane 10 with a cover 24 in a closed position and parts broken away, taken along line 2 as indicated in FIG. 1. A container of pressurized pepper spray 22 is positioned inside the cane 10. The container 22 extends vertically within the vertical member 14. The container 22 is substantially cylindrical extending substantially coaxially within the vertical member 14. The container 22 having a container top having a button 26 is in fluid communication with the container 22 and is located along the upper surface thereof. The button 26 effectively provides an uppermost point to the user when holding the handle 18 of the cane 10 so that the button 26 is easily operated by a thumb of the user. A nozzle 28 projects outwardly from the container 22 through the first end 16 of the handle 18, substantially coaxially with the handle 18. The nozzle 28 can be of any known and suitable design. In its closed position, the cover 24 shields the button 26 from the external environment and prevents it from being accidentally activated. A pair of horizontal tracks 30 extend alongside the handle 18 near the first end of the handle 18. The cover 24 is attached to selectively slide along the horizontal tracks between the closed position wherein the button 26 is covered, to an open position where the button 26 is exposed. To move the cover 24 to the open position, the cover 24 is slid toward the second end of the handle 18.

Figure 3:
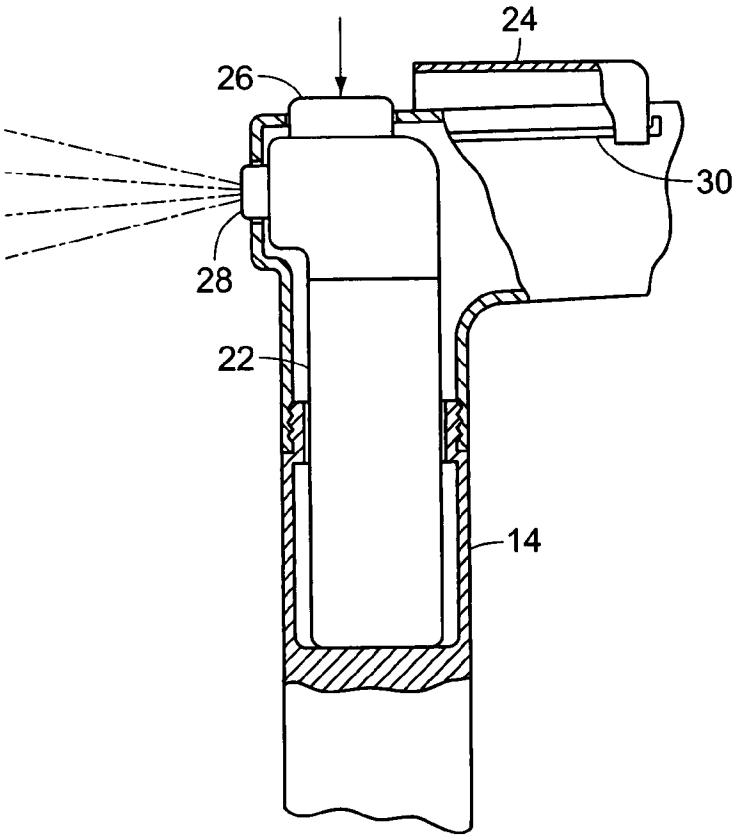
FIG. 3 is a front elevational view of the cane with the cover in an open position and parts broken away, taken along line 2 as indicated in FIG. 1.

FIG. 3 shows the cane 10 with the cover 24 in an open position and parts broken away, taken along line 2 as indicated in FIG. 1. The user has slid the cover 24 to the innermost end of the tracks 30 and has depressed the button 26. Pepper spray releases from the container 22 through the nozzle 28 in a directed spray or mist. Presented with an imminent attack by an assailant, the user can quickly slide the cover 24 into an open position, aim the nozzle 28 near the eyes of the criminal and depress the button 26. The pepper spray that is released incapacitates the attacker for a significant period of time and allows the user to escape.

In conclusion, herein is presented a cane with a pepper spray dispenser. The invention is illustrated by example in the drawing figure, and throughout the written description. It should be understood that numerous variations are possible, while adhering to the inventive concept. Such variations are contemplated as being a part of the present invention.

What is claimed is:

1. A pepper spray dispensing cane, comprising:

a vertical member having an upper end and a lower end, the lower end having a cap from supporting the vertical member upon ground surfaces, the vertical member substantially hollow near the upper end;

a handle having a first end and a second end, the first end joined with the vertical member at a substantially right angle such that the handle extends substantially horizontally;

a pepper spray container, extending substantially vertically within the vertical member near the upper end thereof, the pepper spray container having a top surface having an activation button and a nozzle for spraying pepper spray substantially coaxially with the handle from the first end of the handle when activated by the activation button, the activation button effectually providing an uppermost point of the vertical member to facilitate activation by the user when using the cane for walking and holding the handle.

2. The pepper spray dispensing cane as recited in claim 1, wherein the handle has a pair of tracks extending horizontally thereon, and further comprising a sliding cover mounted upon the tracks for selectively entering a closed position wherein the sliding cover conceals the activation button, and selectively entering an open position wherein the activation button is revealed for use, the sliding cover selectively moving from the closed position to the open position by sliding horizontally upon the tracks toward the second end of the handle.

3. The pepper spray dispensing cane as recited in claim 2, wherein the pepper spray container is substantially cylindrical and extends substantially coaxially within the vertical member.

* * * * *